US005617745A

United States Patent [19]

Della Corte et al.

[11] Patent Number: 5,617,745

[45] Date of Patent: Apr. 8, 1997

[54] SUPPORT SOCK

[76] Inventors: Michael P. Della Corte, 283 Carnation Ave., Floral Park, N.Y. 11001; Daniel Good; David Good, both of 1634 19th Ave., Hickory, N.C. 28601; David E. Shaffer, 386 Spruce La., East Meadow, N.Y. 11554

[21] Appl. No.: 582,870

[22] Filed: Jan. 4, 1996

[51] Int. Cl.[6] ..... A41B 11/00; D04B 11/00; A61M 31/00

[52] U.S. Cl. ..... 66/178 A; 2/239; 607/65

[58] Field of Search ..... 66/178 A, 172 E, 66/196, 27, 65, 66; 2/239

[56] References Cited

U.S. PATENT DOCUMENTS

| | | | |
|---|---|---|---|
| 858,006 | 6/1907 | Lum | 2/239 |
| 1,741,826 | 12/1929 | Christy | 2/239 X |
| 2,219,235 | 10/1940 | Morton | 2/239 |
| 2,334,206 | 11/1943 | Knohl | 2/239 X |
| 4,172,456 | 10/1979 | Zens . | |
| 4,194,249 | 3/1980 | Thorneburg . | |
| 4,253,317 | 3/1981 | Howard et al. . | |
| 4,397,161 | 8/1983 | Chesebro, Jr et al. . | |
| 4,832,010 | 5/1989 | Lerman | 602/65 X |
| 4,841,648 | 6/1989 | Shaffer et al. . | |
| 4,856,505 | 8/1989 | Shaffer et al. . | |
| 5,092,347 | 3/1992 | Shaffer et al. . | |
| 5,103,656 | 4/1992 | Hanson, II . | |
| 5,185,000 | 2/1993 | Brandt et al. | 602/65 X |
| 5,419,161 | 5/1995 | Bodenschantz | 66/196 X |
| 5,464,384 | 11/1995 | Cromartie | 602/65 X |
| 5,473,781 | 12/1995 | Greenberg | 602/66 X |

FOREIGN PATENT DOCUMENTS

| | | |
|---|---|---|
| 0265395A2 | 4/1988 | European Pat. Off. . |
| 2668040A | 4/1992 | France . |
| 670377 | 4/1952 | Switzerland . |
| 741734 | 12/1955 | United Kingdom . |

*Primary Examiner*—John J. Calvert
*Attorney, Agent, or Firm*—Dilworth & Barrese

[57] ABSTRACT

A support sock is provided that stabilizes the ankle without the use of bulky bandages or specialized orthotic type shoes. The sock has elastic material around the ankle area extending down to the arch where the arch and instep are securely bound. The binding of these areas with elastic material restricts the foot of the user while not prohibiting movement. The sock can be worn with or without shoe gear.

5 Claims, 1 Drawing Sheet

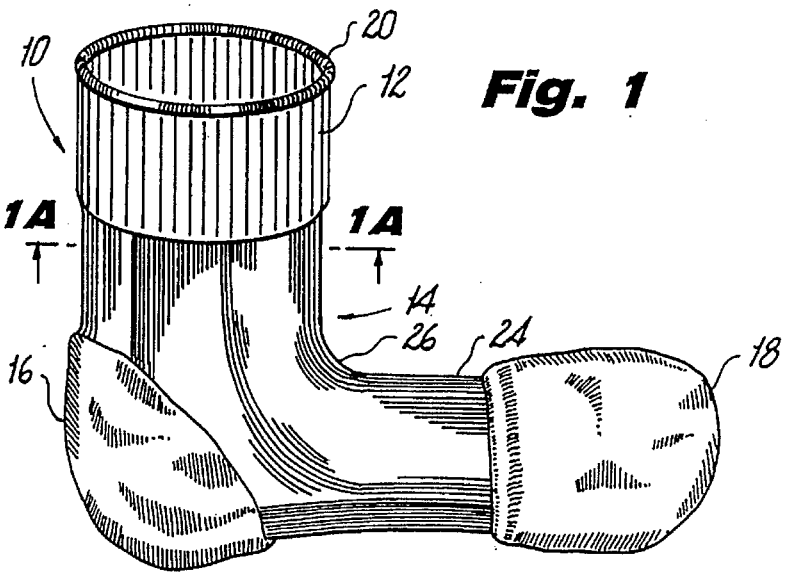
Fig. 1
Fig. 1A
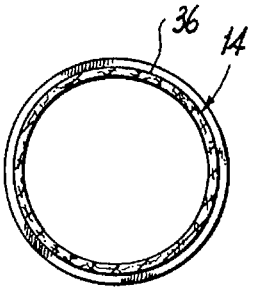
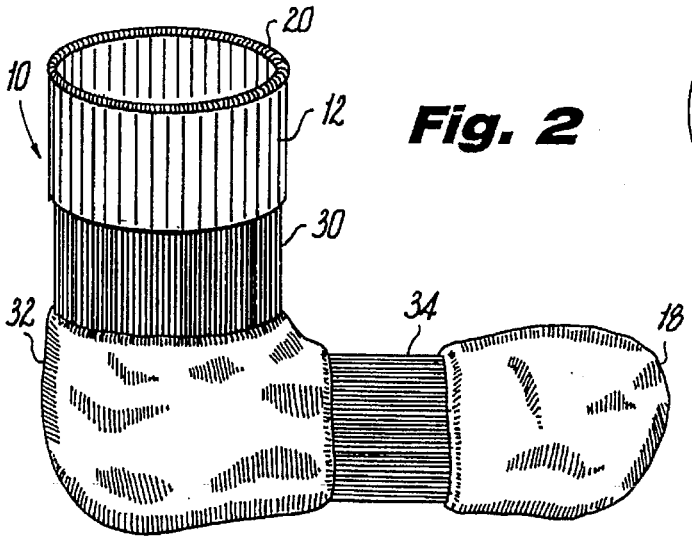
Fig. 2
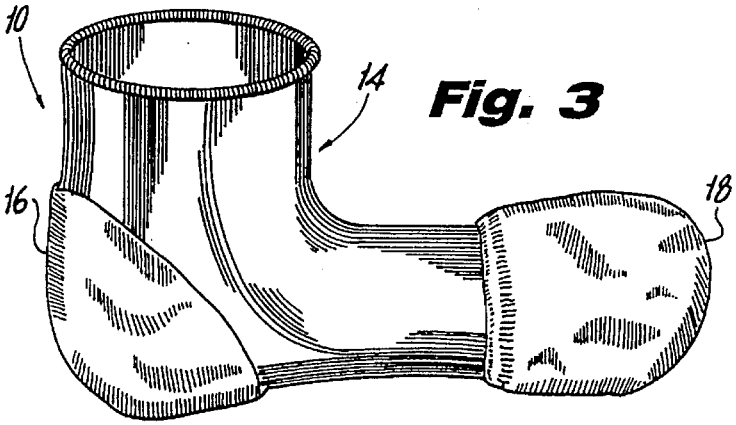
Fig. 3

SUPPORT SOCK

BACKGROUND OF THE INVENTION

1. Field of the Invention

This invention relates generally to corrective footwear and more specifically, to a support sock for ankle stabilization in the prevention and/or rehabilitation of foot injuries.

2. Description of the Related Art

With the recent resurgence of jogging and running, there has been much concern regarding foot and ankle injury. Along with these typical athletic endeavors, there also has been an increase in the use of stationary leg exercising equipment both at health spas and at home. This equipment includes, for example, treadmills, bicycles and stair climbing machines, along with typical aerobic exercising. Although these types of exercises are excellent for the cardiovascular system and overall fitness of the participant, they produce extra stress and strain on the feet and ankles.

These repeated running sports, e.g. football, soccer, jogging, and stationary exercises, especially in the unconditioned or overweight person, can cause, for example, straining, spraining and twisting of the ankle. Twists and strains are typically from overexerting or over-stretching of the muscles whereas a sprain is a joint injury where some of the fibers of a supporting ligament are ruptured. Many doctors recommend using a combination of rest, ice, compression and elevation as therapy immediately following an injury. This can help control inflammation, reduce swelling, relieve pain and speed up the healing process.

More serious injuries are where the ligament is actually torn or one of the ankle bones has broken. These serious types of injuries of the foot normally require medical treatment and often result in the use of a splint or cast to prevent movement of the foot while the healing process takes place. Prior to this immobilization, surgery may be needed to repair the damage to the ligament or bone.

Prior art in the treatment of foot pain and injury prevention has been achieved with the use of supportive padding, strapping and foot orthotics. These treatments attempt to eliminate or minimize lateral and vertical foot movement and redistribute weight-bearing forces. Common conservative treatments typically consist of strapping and padding. The basic presumption being that the pain is relieved when the foot is stabilized or the likelihood of injury is lessened by not allowing the foot to be overextended.

Typically, the strapping comes as an elastic bandage of several feet that the user self-wraps around the ankle or as a pre-form that the user slips on over the foot. Both types have the disadvantage of adding extra bulk, making it extremely cumbersome to wear with a shoe or sneaker. The wrap has the added disadvantages of being time consuming to wrap and unwrap with each use, and each time the wrap is used, the amount of tightness around the ankle will change. At certain times the wrap may be too tight, causing discomfort and possible loss of circulation to the foot, and at other times, too loose and will defeat the intended purpose.

An orthotic is a mechanical device made for the foot or toes that is used to either stabilize the foot or hold it in optimum position to decrease the weight-bearing force in painful areas of the foot. Supports are usually custom made, but are also commercially available. They may be adhered to the foot for temporary relief or made into a permanent removable device. Traditionally, an ankle support must be held securely in a shoe in order to function efficiently. They are typically placed in the patient's shoes and worn daily. The disadvantage in this treatment is that the ankle is only supported when the patient is in shoes.

Numerous corrective footwear have been provided, for example, U.S. Pat. Nos. 4,841,648, 4,856,505 and 5,092,347, all to Shaffer et al. Although there are some socks on the market that claim medical indications, none are addressing ankle support or pain. Some sock manufacturers are using various types of loop systems to give additional padding in the heel and arch area, but do not address the ankle. While these units may be suitable for the particular purpose to which they address, a need still exists for a support device that can be worn with or without shoes without adding an extra layer of bulk.

SUMMARY OF THE INVENTION

The present invention is a support sock with a built-in ankle support, so that it is not required to be worn with shoe gear. The sock gives compression and support for weakened muscles, tendons and ligaments and helps reduce the chance of injury recurrence. The support sock does not have extra bulk allowing the wearer to be with or without shoes. The built in ankle support is achieved by creating a sock with an elastic arch and ankle combination for firm, even compression.

The sock has a foot enclosure portion typically having a heel and toe portion, made up of traditional fabrics such as cotton, wool or synthetics. The stabilization or support component of the sock is made so that the fabric content changes to an elastic/resilient material. This durable type of material permits a full range of movement while maintaining comfortable support. If a top portion is included, as soon as the support component of the sock is completed, the fabric content is then again changed back to the more traditional fabric. The support component is made up of one or more bands around the foot of elastic material encompassing both the arch/instep and ankle areas. The support sock can be utilized in many fields such as in sports and a variety of medical indications, such as heel spur syndrome, plantar fasciitis and metatarsalgia. The sock is a functional device consisting of two main components; a heel and toe component sharing the same fabric content and an elastic middle component that is supportive and at the same time does not add to the bulk of the sock.

BRIEF DESCRIPTION OF THE DRAWINGS

So that one skilled in the art to which the subject invention appertains will better understand how to practice the present invention, preferred embodiments of the apparatus and method will be described in detail hereinbelow with reference to the drawings wherein:

FIG. 1 is a perspective view of a first embodiment of the present invention;

FIG. 1A is a cross-sectional view along section line 1A—1A of FIG. 1;

FIG. 2 is a perspective view of a second embodiment of the present invention; and FIG. 3 is a perspective view of a third embodiment of the present invention.

DETAILED DESCRIPTION OF PREFERRED EMBODIMENTS

FIG. 1 illustrates a support sock, shown generally at 10. A ribbed top section 12 extends to a point between the ankle and knee of the wearer. Typically, the top section ends just below the calf with a narrow elastic band 20. This band typically has reinforced edges for durability and is slightly tighter than the top section as an aid in keeping the top section 12 from slipping and rolling down the user's leg. The top section itself is typically a knitted fabric material such as cotton, wool or synthetic blends.

On the other end of the support sock is a toe section 18. As is the top section, the toe section is made of the same close-fitting, knitted fabric. This section allows the user's foot to breath as well as be an absorbent for perspiration.

Between the top section 12 and the toe section 18 is a small heel section 16. This heel section is made up of the same absorbent, knitted fabric as the other two. This section adds to the absorbency of the sock and comfort to the user.

Connecting these three aforementioned sections is the stabilization section 14. This section is of a much tighter elastic knit having a highly resistant stretchable construction with, for example, rubber threads knitted into the pattern, thus making it a stretchable rubber type cloth material creating a seamless design for proper fit and firm, even compression. This connecting material serves to stabilize and restrict movement of the wearer's foot. An arch portion 24 of the stabilization section 14 wraps around the user's instep and arch of the foot. This also serves to relieve plantar fasciitis. A second portion 22 of this section further wraps around the ankle adding support to the ankle area aids in the prevention of injuries to the area such as sprains or strains from over-stretching or twisting.

These two portions are connected over the top of the foot by a connecting portion 26, forming one continuous stabilization section 14. The entire support stabilization restricts movement of the foot both laterally and vertically by way of the elastic fabric, thus stabilizing the ankle area for increase prevention of injury or further injury. These separate sections are, for example, knitted together as separate components or as one integral sock with elasticized threads knitted into the support areas.

As a further embodiment, the stabilization section 14 is made up of a double-walled, stretchable fabric that has a heat insulating substance, such as neoprene, secured within. As an alternative to the neoprene, a cold generating substance may also be secured within the walls.

In an alternate embodiment, FIG. 2 shows a support sock without the connecting portion of the stabilization section. Instead, the ankle portion 30 and arch/instep portion 34 are separate sections. As with the previous embodiment, the top section is an elastic fabric tube covering at least the ankle area of the leg. This tube is made of stretchable rubber type cloth material knitted either as an integral part of the entire sock with rubberized thread added or as a separate component knitted into the adjacent sections.

The arch/instep section 34 is also an elastic fabric tube covering at least, the instep and arch serving to stabilize and restrict the movement of the wearer. As an added benefit, the arch section, 34 also serves to relieve plantar fasciitis.

Between the ankle and arch/instep sections is a knitted heel section 32. This is made of the same absorbent, breathable material as the top section 12 and toe section 18 as described in the previous embodiment. The heel section 32 wraps around the heel and top of the foot and connects the two support sections. These are either, for example, knitted together as separate components or as one integral sock with elasticized threads knitted into the support areas.

In a further alternate embodiment, FIG. 3 shows a support sock without the ribbed top section. Instead, the support sock ends with the stabilization section 14. As with the previous embodiment, the stabilization section may be one section coveting both the ankle area and the arch/instep or as separate sections. This embodiment may be useful when worn with tight fitting pants and the user does not want the added bulk of the top section. The stabilization section will still be fully functional.

The typical application of this embodiment is as a medium to heavy sock for padding while playing sports or exercising, thus allowing for absorption of perspiration. The support sock would then be used to aid in preventing initial injuries as well as preventing further injury to an ankle. Often, the most painful time to walk with an injured foot is during the business day while wearing regular dress-type shoes. In this case, the foot enclosure portion is made from a synthetic blend being fairly thin. Not needing to further wrap the foot, the user can easily wear a dress shoe without fear of further injury. Along with being able to vary the thickness of the sock, the entire support sock can come in a variety of colors. Typically, an "ACE" bandage only comes in a cream type color and is easily noticeable.

As an addition to the preferred embodiment, the stabilization section is double-walled and a heat insulating substance 36, such as neoprene, is secured within FIG. 1A. The neoprene, or similar substance, acts to retain the therapeutic heat generated by the wearer's foot. This will aid in the circulation and help keep the foot muscles pliable, thus reducing susceptibility to injury. As an alternative, the secured substance is of a cold producing type, allowing the user the benefit of ice and compression at the same time after an injury has occurred.

It will be understood that various modifications may be made to the embodiments disclosed herein. For example, the top section of the support sock described may be omitted and still retain all the properties and advantages of the present invention. Therefore, the above description should not be construed as limiting, but merely as exemplifications of preferred embodiments. Those skilled in the art will envision other modifications within the scope and spirit of the claims appended hereto.

What is claimed is:

1. A support sock comprising:

an ankle stabilization portion having a first knit construction, the ankle stabilization portion being located to encircle an ankle joint, arch and instep of a foot and including a single stabilization section; and a foot enclosure portion having a second knit construction integrally connected to said ankle stabilization portion, the foot enclosure portion including a toe portion, a heel portion, and a top portion located to be positioned above the ankle joint of the foot;

said ankle stabilization portion and said foot enclosure portion enclosing the surface area of a foot about which said ankle stabilization portion substantially surrounds, supports and stabilizes the ankle joint of said foot, said ankle stabilization portion interconnecting the foot enclosure portions, wherein said first and second knit constructions are a continuously knitted fabric.

2. The support sock of claim 1, wherein said foot enclosure is made from a close fitting, knitted fabric.

3. The support sock of claim 2, wherein said first knit construction contains high resistant stretchable elastic material.

4. The support sock of claim 3, wherein said first knit construction is formed by integrally knitting said stretchable elastic material into part of said close fitting, knitted fabric.

5. The support sock of claim 1, wherein said ankle stabilization portion is double-walled and includes a heat insulating substance within.

* * * * *